US007456814B2

(12) United States Patent
Lee et al.

(10) Patent No.: US 7,456,814 B2
(45) Date of Patent: Nov. 25, 2008

(54) LIQUID CRYSTAL DISPLAY WITH 2-PORT DATA POLARITY INVERTER AND METHOD OF DRIVING THE SAME

(75) Inventors: Jae Hyung Lee, Kyoungsangbuk-do (KR); Hyong Yerl Park, Kyoungsangbuk-do (KR); Hyun Il Shin, Kyoungsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 91 days.

(21) Appl. No.: 10/029,848

(22) Filed: Dec. 31, 2001

(65) Prior Publication Data

US 2002/0186193 A1 Dec. 12, 2002

(30) Foreign Application Priority Data

Jun. 7, 2001 (KR) ..... 10-2001-0031795
Oct. 17, 2001 (KR) ..... 10-2001-0064059

(51) Int. Cl.
*G09G 3/36* (2006.01)

(52) U.S. Cl. ..... 345/96

(58) Field of Classification Search ..... 345/98, 345/96, 99, 100, 97, 103, 205, 206, 87
See application file for complete search history.

(56) References Cited

U.S. PATENT DOCUMENTS 4,580,265 A * 4/1986 Gooding et al. ..... 714/802
5,856,816 A * 1/1999 Youn ..... 345/98
5,917,364 A * 6/1999 Nakamura ..... 327/415
6,271,822 B1 * 8/2001 Chiang ..... 345/99
6,335,718 B1 * 1/2002 Hong et al. ..... 345/98
6,348,915 B1 * 2/2002 Yamashita et al. ..... 345/204
6,980,192 B1 12/2005 Matsumura et al.
2001/0002829 A1 * 6/2001 Nishimura ..... 345/96

FOREIGN PATENT DOCUMENTS

| | | |
|---|---|---|
| JP | 05-334206 | 12/1993 |
| JP | 09-015560 | 1/1997 |
| JP | 10-161592 | 6/1998 |
| JP | 11-282421 | 10/1999 |
| JP | 2000-292768 | 10/2000 |
| JP | 2001-166740 | 6/2001 |
| JP | 2001-324965 | 11/2001 |

* cited by examiner

*Primary Examiner*—Sumati Lefkowitz
*Assistant Examiner*—Srilakshmi K Kumar
(74) *Attorney, Agent, or Firm*—Morgan, Lewis & Bockius LLP

(57) ABSTRACT

The specification and drawings describe and show embodiments of the present invention in the form of a liquid crystal display with a 2-port data polarity inverter. More specifically, the liquid crystal display includes a liquid crystal polarity inversion driver determining whether a polarity of a liquid crystal is inverted and inverting the polarity of the liquid crystal in accordance with the determined result, a first data polarity inversion driver determining whether a first data transition is occurred in first data inverting the polarity of the first data in accordance with the determined result, and a second data polarity inversion driver determining whether a second data transition is occurred and inverting the polarity of the second data in accordance with the determined result.

13 Claims, 17 Drawing Sheets

FIG.11

| | Dn | Dn-1 | Dn-2 | Dn-3 | Dn-4 | Dn-5 | Dn-6 | Dn-7 | Dn-8 |
|---|---|---|---|---|---|---|---|---|---|
| RE0 | 1 | 0 | 0 | 0 | 1 | 0 | 0 | 0 | 1 |
| RE1 | 1 | 0 | 0 | 0 | 1 | 0 | 0 | 0 | 1 |
| RE2 | 1 | 0 | 0 | 0 | 1 | 0 | 0 | 0 | 1 |
| RE3 | 1 | 0 | 0 | 0 | 1 | 0 | 0 | 0 | 1 |
| RE4 | 1 | 0 | 0 | 0 | 1 | 0 | 0 | 0 | 1 |
| RE5 | 1 | 0 | 0 | 0 | 1 | 0 | 0 | 0 | 1 |
| GE0 | 1 | 0 | 0 | 0 | 1 | 0 | 0 | 0 | 1 |
| GE1 | 1 | 0 | 0 | 0 | 1 | 0 | 0 | 0 | 1 |
| GE2 | 1 | 0 | 0 | 0 | 1 | 0 | 0 | 0 | 1 |
| GE3 | 1 | 0 | 0 | 0 | 1 | 0 | 0 | 0 | 1 |
| GE4 | 1 | 0 | 0 | 0 | 1 | 0 | 0 | 0 | 1 |
| GE5 | 1 | 0 | 0 | 0 | 1 | 0 | 0 | 0 | 1 |
| BE0 | 1 | 0 | 0 | 0 | 1 | 0 | 0 | 0 | 1 |
| BE1 | 1 | 0 | 0 | 0 | 1 | 0 | 0 | 0 | 1 |
| BE2 | 1 | 0 | 0 | 0 | 1 | 0 | 0 | 0 | 1 |
| BE3 | 1 | 0 | 0 | 0 | 1 | 0 | 0 | 0 | 1 |
| BE4 | 1 | 0 | 0 | 0 | 1 | 0 | 0 | 0 | 1 |
| BE5 | 1 | 0 | 0 | 0 | 1 | 0 | 0 | 0 | 1 |
| | | | | | | | | | |
| RO0 | 0 | 0 | 0 | 1 | 0 | 0 | 0 | 1 | 0 |
| RO1 | 0 | 0 | 0 | 1 | 0 | 0 | 0 | 1 | 0 |
| RO2 | 0 | 0 | 0 | 1 | 0 | 0 | 0 | 1 | 0 |
| RO3 | 0 | 0 | 0 | 1 | 0 | 0 | 0 | 1 | 0 |
| RO4 | 0 | 0 | 0 | 1 | 0 | 0 | 0 | 1 | 0 |
| RO5 | 0 | 0 | 0 | 1 | 0 | 0 | 0 | 1 | 0 |
| GO0 | 0 | 0 | 0 | 1 | 0 | 0 | 0 | 1 | 0 |
| GO1 | 0 | 0 | 0 | 1 | 0 | 0 | 0 | 1 | 0 |
| GO2 | 0 | 0 | 0 | 1 | 0 | 0 | 0 | 1 | 0 |
| GO3 | 0 | 0 | 0 | 1 | 0 | 0 | 0 | 1 | 0 |
| GO4 | 0 | 0 | 0 | 1 | 0 | 0 | 0 | 1 | 0 |
| GO5 | 0 | 0 | 0 | 1 | 0 | 0 | 0 | 1 | 0 |
| BO0 | 0 | 0 | 0 | 1 | 0 | 0 | 0 | 1 | 0 |
| BO1 | 0 | 0 | 0 | 1 | 0 | 0 | 0 | 1 | 0 |
| BO2 | 0 | 0 | 0 | 1 | 0 | 0 | 0 | 1 | 0 |
| BO3 | 0 | 0 | 0 | 1 | 0 | 0 | 0 | 1 | 0 |
| BO4 | 0 | 0 | 0 | 1 | 0 | 0 | 0 | 1 | 0 |
| BO5 | 0 | 0 | 0 | 1 | 0 | 0 | 0 | 1 | 0 |

DATA OUTPUT UPON REV OFF

FIG.12

| | Dn | Dn-1 | Dn-2 | Dn-3 | Dn-4 | Dn-5 | Dn-6 | Dn-7 | Dn-8 |
|---|---|---|---|---|---|---|---|---|---|
| RE0 | 0 | 1 | 1 | 0 | 0 | 1 | 1 | 1 | 1 |
| RE1 | 0 | 1 | 1 | 0 | 0 | 1 | 1 | 1 | 1 |
| RE2 | 0 | 1 | 1 | 0 | 0 | 1 | 1 | 1 | 1 |
| RE3 | 0 | 1 | 1 | 0 | 0 | 1 | 1 | 1 | 1 |
| RE4 | 0 | 1 | 1 | 0 | 0 | 1 | 1 | 1 | 1 |
| RE5 | 0 | 1 | 1 | 0 | 0 | 1 | 1 | 1 | 1 |
| GE0 | 0 | 1 | 1 | 0 | 0 | 1 | 1 | 1 | 1 |
| GE1 | 0 | 1 | 1 | 0 | 0 | 1 | 1 | 1 | 1 |
| GE2 | 0 | 1 | 1 | 0 | 0 | 1 | 1 | 1 | 1 |
| GE3 | 0 | 1 | 1 | 0 | 0 | 1 | 1 | 1 | 1 |
| GE4 | 0 | 1 | 1 | 0 | 0 | 1 | 1 | 1 | 1 |
| GE5 | 0 | 1 | 1 | 0 | 0 | 1 | 1 | 1 | 1 |
| BE0 | 0 | 1 | 1 | 0 | 0 | 1 | 1 | 1 | 1 |
| BE1 | 0 | 1 | 1 | 0 | 0 | 1 | 1 | 1 | 1 |
| BE2 | 0 | 1 | 1 | 0 | 0 | 1 | 1 | 1 | 1 |
| BE3 | 0 | 1 | 1 | 0 | 0 | 1 | 1 | 1 | 1 |
| BE4 | 0 | 1 | 1 | 0 | 0 | 1 | 1 | 1 | 1 |
| BE5 | 0 | 1 | 1 | 0 | 0 | 1 | 1 | 1 | 1 |
| | | | | | | | | | |
| RO0 | 1 | 1 | 1 | 1 | 1 | 1 | 1 | 0 | 0 |
| RO1 | 1 | 1 | 1 | 1 | 1 | 1 | 1 | 0 | 0 |
| RO2 | 1 | 1 | 1 | 1 | 1 | 1 | 1 | 0 | 0 |
| RO3 | 1 | 1 | 1 | 1 | 1 | 1 | 1 | 0 | 0 |
| RO4 | 1 | 1 | 1 | 1 | 1 | 1 | 1 | 0 | 0 |
| RO5 | 1 | 1 | 1 | 1 | 1 | 1 | 1 | 0 | 0 |
| GO0 | 1 | 1 | 1 | 1 | 1 | 1 | 1 | 0 | 0 |
| GO1 | 1 | 1 | 1 | 1 | 1 | 1 | 1 | 0 | 0 |
| GO2 | 1 | 1 | 1 | 1 | 1 | 1 | 1 | 0 | 0 |
| GO3 | 1 | 1 | 1 | 1 | 1 | 1 | 1 | 0 | 0 |
| GO4 | 1 | 1 | 1 | 1 | 1 | 1 | 1 | 0 | 0 |
| GO5 | 1 | 1 | 1 | 1 | 1 | 1 | 1 | 0 | 0 |
| BO0 | 1 | 1 | 1 | 1 | 1 | 1 | 1 | 0 | 0 |
| BO1 | 1 | 1 | 1 | 1 | 1 | 1 | 1 | 0 | 0 |
| BO2 | 1 | 1 | 1 | 1 | 1 | 1 | 1 | 0 | 0 |
| BO3 | 1 | 1 | 1 | 1 | 1 | 1 | 1 | 0 | 0 |
| BO4 | 1 | 1 | 1 | 1 | 1 | 1 | 1 | 0 | 0 |
| BO5 | 1 | 1 | 1 | 1 | 1 | 1 | 1 | 0 | 0 |

DATA OUTPUT UPON REV ON

FIG.13

| | Dn | Dn-1 | Dn-2 | Dn-3 | Dn-4 | Dn-5 | Dn-6 | Dn-7 | Dn-8 |
|---|---|---|---|---|---|---|---|---|---|
| RE0 | 1 | 1 | 1 | 1 | 1 | 1 | 1 | 1 | 1 |
| RE1 | 1 | 1 | 1 | 1 | 1 | 1 | 1 | 1 | 1 |
| RE2 | 1 | 1 | 1 | 1 | 1 | 1 | 1 | 1 | 1 |
| RE3 | 1 | 1 | 1 | 1 | 1 | 1 | 1 | 1 | 1 |
| RE4 | 1 | 1 | 1 | 1 | 1 | 1 | 1 | 1 | 1 |
| RE5 | 1 | 1 | 1 | 1 | 1 | 1 | 1 | 1 | 1 |
| GE0 | 1 | 1 | 1 | 1 | 1 | 1 | 1 | 1 | 1 |
| GE1 | 1 | 1 | 1 | 1 | 1 | 1 | 1 | 1 | 1 |
| GE2 | 1 | 1 | 1 | 1 | 1 | 1 | 1 | 1 | 1 |
| GE3 | 1 | 1 | 1 | 1 | 1 | 1 | 1 | 1 | 1 |
| GE4 | 1 | 1 | 1 | 1 | 1 | 1 | 1 | 1 | 1 |
| GE5 | 1 | 1 | 1 | 1 | 1 | 1 | 1 | 1 | 1 |
| BE0 | 1 | 1 | 1 | 1 | 1 | 1 | 1 | 1 | 1 |
| BE1 | 1 | 1 | 1 | 1 | 1 | 1 | 1 | 1 | 1 |
| BE2 | 1 | 1 | 1 | 1 | 1 | 1 | 1 | 1 | 1 |
| BE3 | 1 | 1 | 1 | 1 | 1 | 1 | 1 | 1 | 1 |
| BE4 | 1 | 1 | 1 | 1 | 1 | 1 | 1 | 1 | 1 |
| BE5 | 1 | 1 | 1 | 1 | 1 | 1 | 1 | 1 | 1 |
| | | | | | | | | | |
| RO0 | 0 | 0 | 0 | 0 | 0 | 0 | 0 | 0 | 0 |
| RO1 | 0 | 0 | 0 | 0 | 0 | 0 | 0 | 0 | 0 |
| RO2 | 0 | 0 | 0 | 0 | 0 | 0 | 0 | 0 | 0 |
| RO3 | 0 | 0 | 0 | 0 | 0 | 0 | 0 | 0 | 0 |
| RO4 | 0 | 0 | 0 | 0 | 0 | 0 | 0 | 0 | 0 |
| RO5 | 0 | 0 | 0 | 0 | 0 | 0 | 0 | 0 | 0 |
| GO0 | 0 | 0 | 0 | 0 | 0 | 0 | 0 | 0 | 0 |
| GO1 | 0 | 0 | 0 | 0 | 0 | 0 | 0 | 0 | 0 |
| GO2 | 0 | 0 | 0 | 0 | 0 | 0 | 0 | 0 | 0 |
| GO3 | 0 | 0 | 0 | 0 | 0 | 0 | 0 | 0 | 0 |
| GO4 | 0 | 0 | 0 | 0 | 0 | 0 | 0 | 0 | 0 |
| GO5 | 0 | 0 | 0 | 0 | 0 | 0 | 0 | 0 | 0 |
| BO0 | 0 | 0 | 0 | 0 | 0 | 0 | 0 | 0 | 0 |
| BO1 | 0 | 0 | 0 | 0 | 0 | 0 | 0 | 0 | 0 |
| BO2 | 0 | 0 | 0 | 0 | 0 | 0 | 0 | 0 | 0 |
| BO3 | 0 | 0 | 0 | 0 | 0 | 0 | 0 | 0 | 0 |
| BO4 | 0 | 0 | 0 | 0 | 0 | 0 | 0 | 0 | 0 |
| BO5 | 0 | 0 | 0 | 0 | 0 | 0 | 0 | 0 | 0 |

DATA OUTPUT UPON REV 1,2 DRIVING (DC LEVEL)

LIQUID CRYSTAL DISPLAY WITH 2-PORT DATA POLARITY INVERTER AND METHOD OF DRIVING THE SAME

This application claims the benefit of Korean Application Nos. P2001-31795 and P2001-64059 filed on Jun. 07, 2001, and Oct. 17, 2001, which is hereby incorporated by reference.

BACKGROUND OF THE INVENTION

1. Field of the Invention

The present invention relates to a liquid crystal display, and more particularly, to a liquid crystal display with a 2-port data polarity inverter and a method of driving the same. Although the present invention is suitable for a wide scope of applications, it is particularly suitable for reducing a current consumption as well as improving an electromagnetic interference (EMI) characteristic.

2. Discussion of the Related Art

Generally, a liquid crystal display (LCD) controls a light transmittance of each liquid crystal cell in accordance with a video signal, thereby displaying an image. An active matrix LCD including a switching device for each liquid crystal cell is suitable for displaying a dynamic image. The active matrix LCD uses a thin film transistor (TFT) as a switching device.

Since such an active matrix LCD is realized as a smaller device than a conventional cathode ray tube (CRT), it has been widely used for a monitor for a personal computer or a notebook computer as well as office automation equipment, such as a copy machine, and portable equipment, such as a cellular phone and a pager.

As shown in FIG. 1, a driving apparatus for the LCD includes a system driver 1 for converting an analog signal into digital video data, a data driver 3 for applying the video data to data lines DL of a liquid crystal panel 6, a gate driver 5 for sequentially driving gate lines GL of the liquid crystal panel 6, a timing controller 2 for controlling the data driver 3 and the gate driver 5, and a gamma voltage generator 4 for applying a gamma voltage to the data driver 3.

More specifically, the liquid crystal panel 6, a liquid crystal is injected between two glass substrates, and the gate lines GL and the data lines DL are formed on the lower glass substrate in such a manner to be perpendicular to each other. At each intersection between the gate lines GL and the data lines DL, a thin film transistor (TFT) for selectively applying an image inputted from the data lines DL to a liquid crystal cell Clc is provided. To this end, the TFT has a drain terminal connected to the gate line GL and a source terminal connected to the data line DL. The drain terminal of the TFT is connected to a pixel electrode of the liquid crystal cell Clc.

The system driver 1 converts an analog input image signal into a digital image signal suitable for the liquid crystal panel 6 and detects a synchronizing signal included in the image signal. A low voltage differential signal (LVDS) interface and a TTL interface are mainly used for data and control signal transmissions of the system driver 1. Alternatively, such interface functions, along with the timing controller 2, may be integrated into a single chip. In the LVDS interface, various data are compressed to a single line and inputted to the timing controller. An electric field induced in accordance with a current flow is formed at each line into which data are transmitted. An emission of this electric field causes an electromagnetic interference (EMI) phenomenon in which a signal transmitted to the adjacent lines is loaded with a noise, thereby interfering a normal operation. Due to this EMI phenomenon, a voltage of the data signal is lowered.

In order to overcome such an EMI phenomenon, a scheme of transmitting a differential signal has been suggested. Herein, the differential signal means a signal having a relationship as shown in FIG. 2 of the same amplitude and the inverse phase. When lines simultaneously transmitting positive and negative signals S+ and S− are adjacent to each other, electric fields generated from each of the adjacent lines are vanished due to their mutual action. More specifically, when the positive signal S+ is converted from a low level into a high level, the negative signal S− is converted from a high level into a low level. At this time, directions of the currents flowing in both lines become opposite to each other. Hence, electric fields generated in the opposite direction are cancelled by the Fleming's rule. This cancellation of the electric fields minimizes an emission of the electric field. Accordingly, a data signal having an original voltage can be applied to the timing controller.

The timing controller 2 applies red (R), green (G), and blue (B) data signals received from the system driver 1 to the data driver 3. Also, the timing controller 2 generates a dot clock Dclk and a gate start pulse GSP using horizontal/vertical synchronizing signals H and V and a data enable signal DE inputted from the system driver 1, thereby controlling a timing of the data driver 3 and the gate driver 5. The dot clock Dclk is applied to the data driver 3 while the gate start pulse GSP is applied to the gate driver 5.

The gate driver 5 includes a shift register for responding to the gate start pulse GSP inputted from the timing controller 2 to sequentially generate a scanning pulse, and a level shifter for shifting a voltage of the scanning pulse into a voltage level suitable for driving the liquid crystal cell. Video data at the data line DL are applied to a pixel electrode of the liquid crystal cell Clc by the TFT in response to the scanning pulse inputted from the gate driver 5.

The dot clock Dclk, along with the R, G, and B data signals from the controller 2, is inputted to the data driver 3. The data driver 3 latches the R, G, and B digital video data in synchronization with the dot clock Dclk and then corrects the latched data in accordance with a gamma voltage Vγ. Then, the data driver 3 converts data corrected by the gamma voltage Vγ into analog data and supplies it to the data line DL line by line.

The gamma voltage generator 4 generates a gamma voltage Vγ corresponding to data for a gray scale value based on an electro-optical characteristic of a liquid crystal display panel. The gamma voltage Vγ is a voltage divided in correspondence with a gray level by means of the gamma voltage generator 4. Thus, the gamma voltage Vγ generated from the gamma voltage generator 4 has a different voltage magnitude in correspondence with a gray scale value selected in an expressible range.

FIG. 3 is a detailed block diagram of the timing controller 2 shown in FIG. 1.

Referring to FIG. 3, the timing controller 2 generates desired signals for driving the LCD using the low voltage differential signal LVDS, the vertical and horizontal synchronizing signals H and V, and the data enable signal DE from the system driver 1.

The LVDS applies R, G, and B data signals through a data aligner 12 to the data driver 3. The vertical and horizontal synchronizing signals V and H apply timing control signals through a timing control signal generator to the data driver 3 and the gate driver 5.

Control signals required for the data driver 3 in these timing signals includes a source sampling clock SSC, a source output enable signal SOE, and a source start pulse SSP, etc. On the other hand, control signals required for the gate driver 5 include a gate shift clock GSC, a gate output enable signal GOE, and a gate start pulse GSP, etc.

The horizontal and vertical synchronizing signals H and V apply a polarity control signal through a polarity control signal generator 16 to the data driver 3 and the gate driver 5.

Such an LCD applies the data signals and the control signals from the system driver 1 through the timing controller 2 to the data driver 3 and the gate driver 5.

FIG. 4A is a detailed block diagram of a conventional REV transmitter within the timing controller 2.

Referring to FIG. 4A, the REV transmitter includes a data transition checker 30 for checking a transition of data, a REV signal summer 32 for detecting the number of signals in which a polarity of the data according to the data transition is changed to determine an output level, and a REV signal output 34 for receiving signals from the data transition checker 30 and the REV signal summer 32 to generate a signal for inverting output data.

More specifically, the data transition checker 30 consists of two flip-flops 36 and 38, and an exclusive logical sum gate XOR 40. The data transition checker 30 compares the current data flip-flop 36 with the previous data flip-flop 38 to check whether the data are changed into a high logic '1' or a low logic '0', and vice versa. If there is a transition of the data, the data transition part 30 outputs a high logic '1'. Conversely, if there is no transition of a data, the data transition part 30 outputs a low logic '0'. In this case, the data is sequentially compared regardless of the status of the data, i.e., even data EVEN or odd data ODD.

The REV signal summer 32 adds all the number of data having a data transition through the data transition part 30 by means of adders 42 and 44 with respect to each thirty-six R, G, and B even and odd data. At this time, a majority detector 46 determines whether the number of a high logic '1' is more than eighteen, that is a half of the total number of the R, G, and B data. If the majority detector 46 determines that the number of a high logic '1', which is an output with a data transition, is more than eighteen which is a half of thirty-six bits, the REV having a high logic '1' is outputted. Conversely, if it determines that the number of a high logic '1' is less than eighteen, the REV having a low logic '0' is outputted.

The REV signal output 34 outputs a signal inverting output data when an output REV of the REV signal summer 32 is '1' by using 2×1 multiplexors 48 and 50. In other words, in order to reduce a data transition amount when the number of the data transition is more than a half, the REV signal output 34 sends a data polarity-inverting signal for inverting an output signal to execute a transition of the output signal by {thirty-six -(data transition amount more than eighteen)} only. Accordingly, a REV signal for allowing unchanged input data to be recognized in a low logic while allowing inverted input data to be recognized in a high logic is inputted to the data driver 3.

FIG. 4B is a schematic block diagram of a REV receiver within the data driver 3.

Referring to FIG. 4B, the REV receiver 35 includes 2×1 multiplexors 48' and 50'. Each of the input terminals of these multiplexors 48' and 50' is connected such that the signals outputted through the multiplexors 48 and 50 of the REV signal output 34 in FIG. 4A are inputted without a transition. Another input terminal thereof is connected such that the signals from the REV signal output 34 in FIG. 4A are inputted with an inverted state. The REV signals inputted to the multiplexors 48 and 50 are selected as the normal signals or the inverted signals by a high signal ('1') or a low signal ('0') from the majority detector 46 of the REV signal summer. The signals are then inputted to a latch circuit configuring the data driver 3, thereby inverting the polarities of the R, G and B data.

FIG. 5 schematically illustrates a conventional REV driving method.

Referring to FIG. 5, the current clock data are compared with the previous clock data with respect to thirty-six bits of the even and odd data EVEN and ODD, so that the number of data transition is reduced. In other words, $1^{st}$ clock data CLK1 are compared with $2^{nd}$ clock data CLK2 to determine whether there is a data transition.

Such a driving method is to compare transitions before and after 36-bit data inputted from the timing controller 2 to the liquid crystal module using a single port, and applying a signal for inverting the data if the data have more than eighteen bits. Conversely, an existing data is sent if the data have less than eighteen bits. However, the conventional driving method has a disadvantage in that, since the REV signal is selected in response to many data transitions, a current consumption is inevitably increased. As a result, a lot of electromagnetic waves are generated.

SUMMARY OF THE INVENTION

Accordingly, the present invention is directed to a liquid crystal display with a 2-port data polarity inverter and a method of driving the same that substantially obviates one or more of problems due to limitations and disadvantages of the related art.

Another object of the present invention is to provide a liquid crystal display with a 2-port data polarity inverter and a method of driving the same in that a 2-port REV signal is used in the timing controller driving system to reduce the number of data transitions into a half, thereby lowering a current consumption as well as improving an electromagnetic interference (EMI) characteristic.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display includes a liquid crystal polarity inversion driver determining whether a polarity of a liquid crystal is inverted and inverting the polarity of the liquid crystal in accordance with the determined result, a first data polarity inversion driver determining whether a first data transition is occurred in first data and inverting the polarity of the first data in accordance with the determined result, and a second data polarity inversion driver determining whether a second data transition is occurred and inverting the polarity of the second data in accordance with the determined result.

In the liquid crystal display, the first data polarity inversion driver includes a first data transition part determining whether the first data transition is occurred in the first data and outputting a first signal, a first data polarity inversion signal summer counting the number of the first signal that a data polarity is changed according to the first data transition determining whether an output level is high or low, and a first data polarity inversion signal output part receiving the first signal and the determined output level from the first data transition part and the first data polarity inversion signal summer and outputting an inverting signal for inverting output data.

The second data polarity inversion driver includes a second data transition part determining whether the second data transition is occurred in the second data and outputting a second signal, a second data polarity inversion signal summer counting the number of the second signal that a data polarity is changed according to the second data transition and determining whether an output level is high or low, and a second data polarity inversion signal output part receiving the second signal and the determined output level from the second data transition part and the second data polarity inversion signal summer and outputting an inverting signal for inverting output data.

The first data transition part includes first and second flip-flops and an exclusive logical sum gate comparing current data with previous data to determine whether the first data transition is occurred in accordance with the compared result.

The second data transition part includes first and second flip-flops and an exclusive logical sum gate comparing current data with previous data to determine whether the second data transition is occurred in accordance with the compared result.

The first data polarity inversion signal summer includes an adder adding the number of data with a data transition from the first data transition part, and a majority detector determining whether the added number of the data is higher than a first reference value.

The second data polarity inversion signal summer includes an adder adding the number of data with a data transition from the second data transition part, and a majority detector determining whether the added number of the data is higher than a second reference value.

The first data polarity inversion signal output part includes a multiplexor receiving a first polarity inversion signal from the first data polarity inversion signal summer to invert the output data.

The second data polarity inversion signal output part includes a multiplexor receiving a second polarity inversion signal from the second data polarity inversion signal summer to invert the output data.

In the liquid crystal display device, the first and second data are odd data and even data, respectively.

In another aspect of the present invention, a method of driving liquid crystal display having first and second data polarity inversion drivers includes dividing input data by first and second data, inputting the first and second data to the first and second data polarity inversion drivers, respectively, determining the number of first and second data transitions in the first and second data, respectively, and inverting a polarity of the first and second data in accordance with the determined results.

In the method, the inverting a polarity of the first and second data includes comparing current first data with previous odd data to determine whether there is the first and second data transitions, adding the number of the first and second data having the first and second data transitions, and inverting the first and second data if the number of the added data is more than a half of a total number of the input data bit and outputting the input data without an inversion if the number of the added data is less than or equal to a half of the total number of the input data bit.

In the method, the first and second data are odd and even data, respectively. The total number of the input data bit is 18, and the number of the first and second data bits is 9.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings:

FIG. 11 illustrates a data output state when REV is turned off;

FIG. 12 is a table showing a data output state when a conventional 1-port REV signal is used;

FIG. 13 is a table showing a data output state when a 2-port REV signal is used according to the present invention;

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 1:
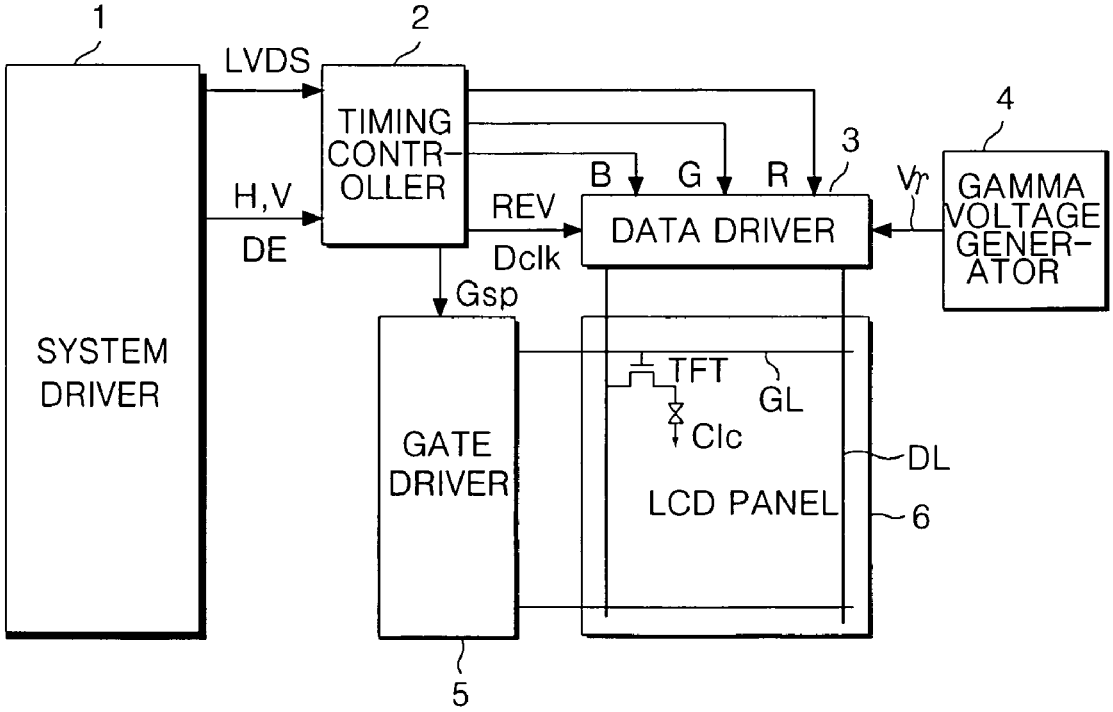
FIG. 1 RELATED ART
FIG. 1 is a block diagram showing a configuration of a conventional liquid crystal display.
Figure 2:
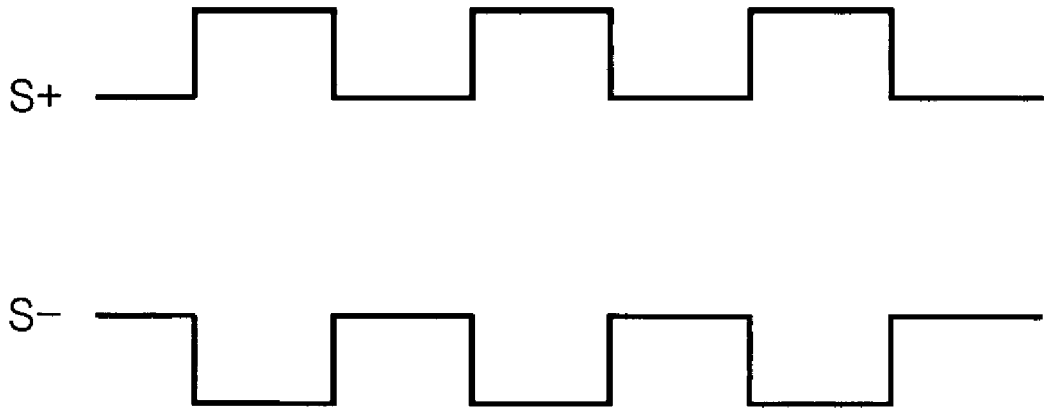
FIG. 2 RELATED ART
FIG. 2 is a waveform diagram showing a variation with respect to a time in a gate high voltage and a common voltage applied to the thin film transistor of FIG. 1.
Figure 3:
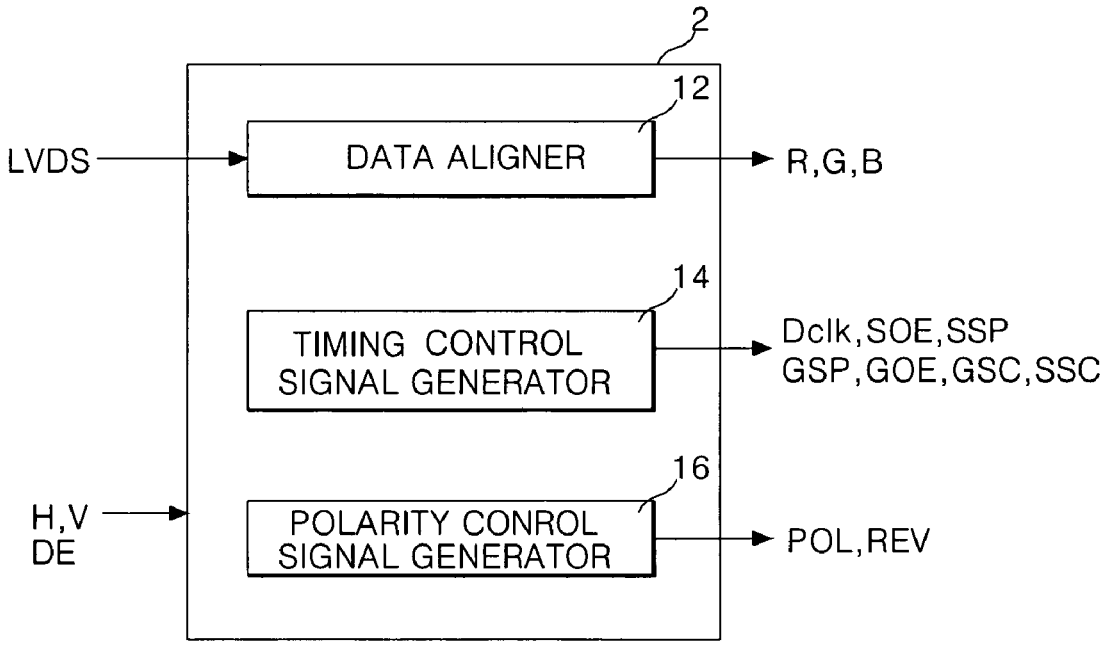
FIG.3 RELATED ART
FIG. 3 is a detailed block diagram of the timing controller of FIG. 1.
Figure 4A:
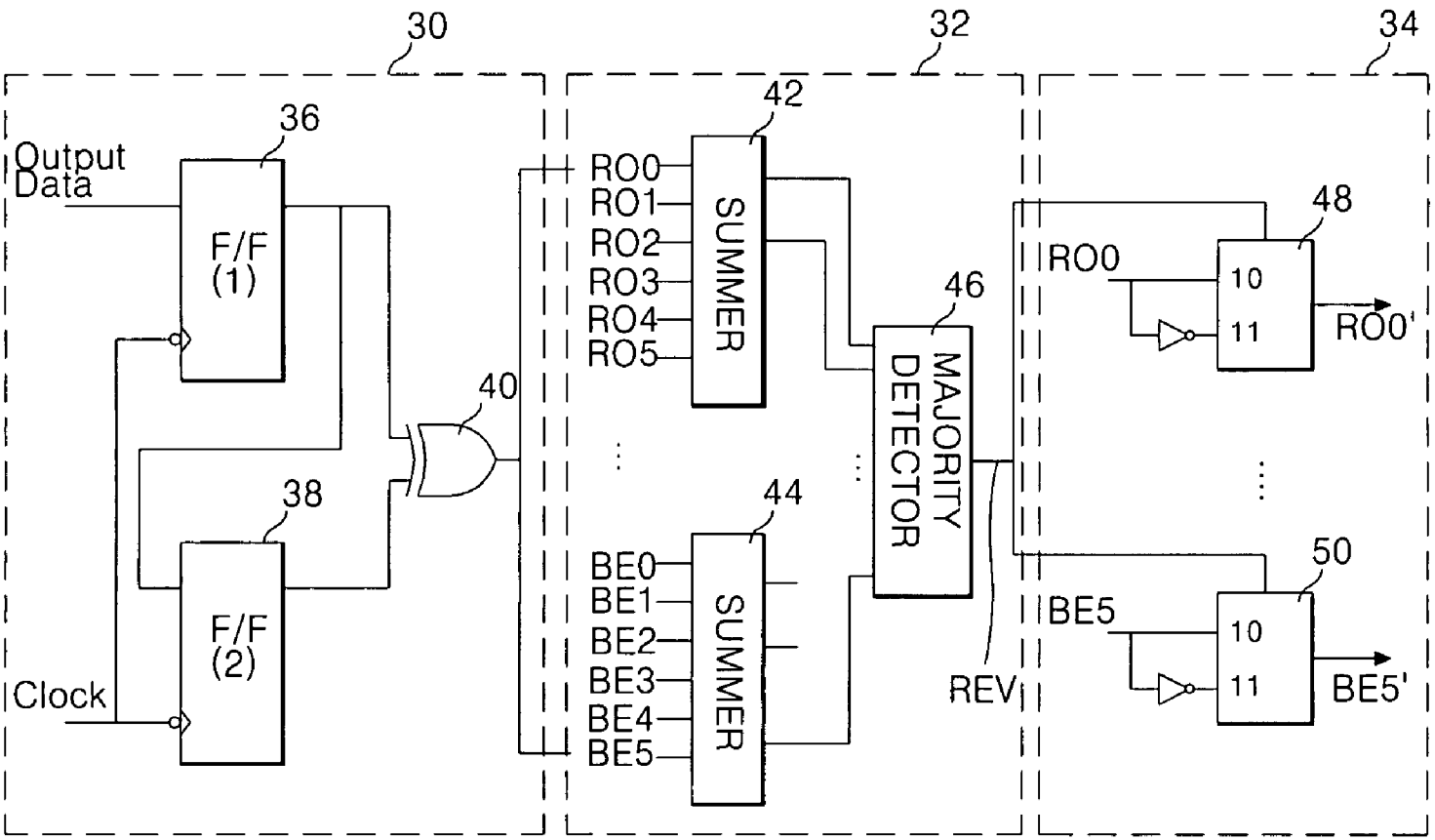
FIG.4A RELATED ART
FIG. 4A is a detailed block diagram of a conventional REV transmitter of the timing controller of FIG. 1.
Figure 4B:
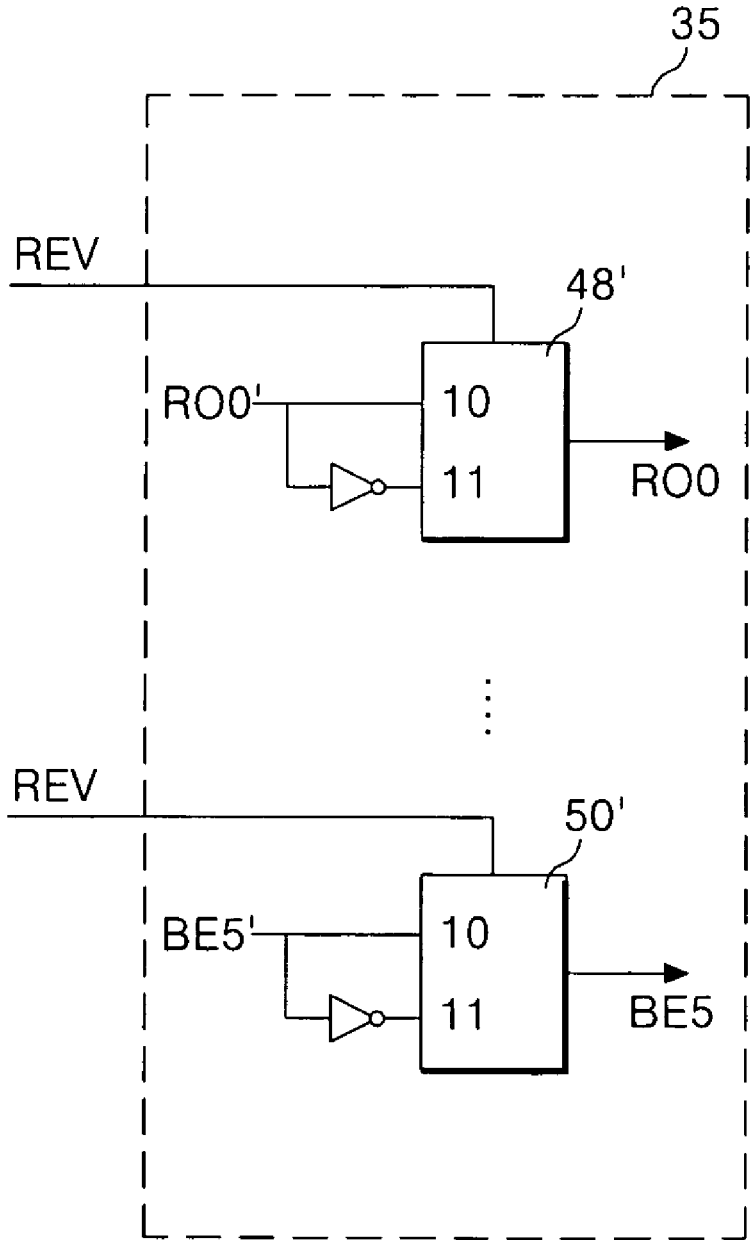
FIG. 4B RELATED ART
FIG. 4B is a detailed block diagram of a conventional REV receiver of the data driver corresponding to the REV transmitter of FIG. 4A.
Figure 5:
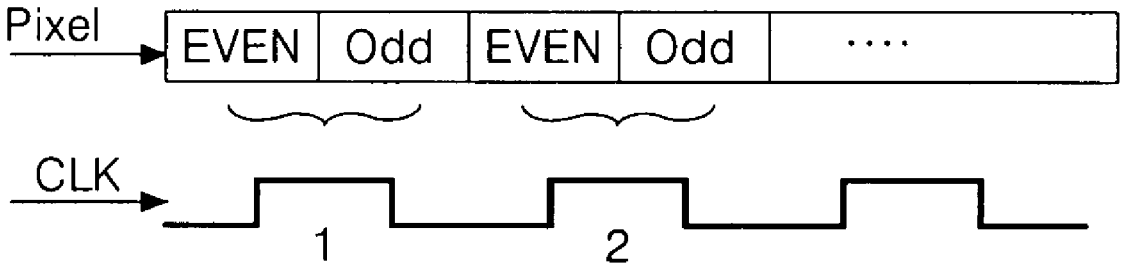
FIG. 5 RELATED ART
FIG. 5 schematically illustrates a conventional REV driving method.
Figure 6:
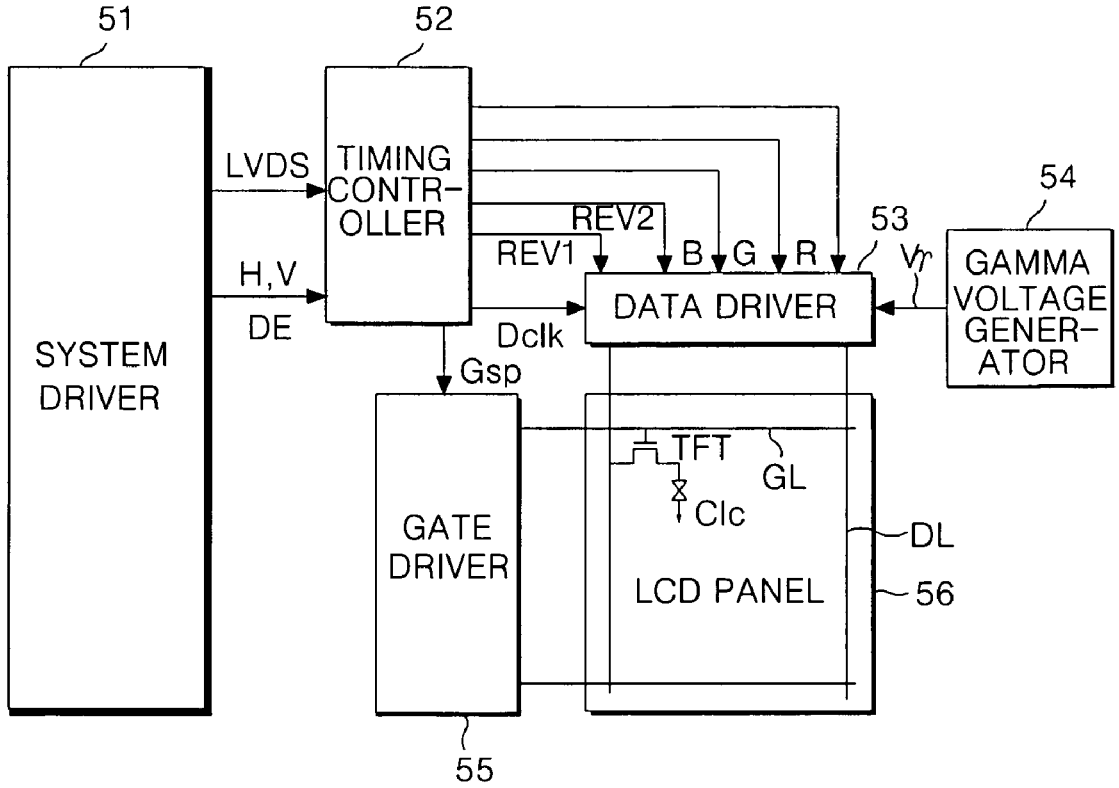
FIG. 6 is a block diagram showing a configuration of a liquid crystal display according to the present invention.

FIG. 6 illustrates a liquid crystal display (LCD) according to the present invention.

Referring to FIG. 6, a driving apparatus for the LCD includes a system driver 51 for converting an analog signal into a digital video signal, a data driver 53 for applying the digital video signal to data lines DL of a liquid crystal panel 56, a gate driver 55 for sequentially driving gate lines GL of the liquid crystal panel 56, a timing controller 52 for controlling the data driver 53 and the gate driver 55, and a gamma voltage generator 54 for applying a gamma voltage to the data driver 53.

More specifically, in the liquid crystal panel 56, a liquid crystal is injected between two glass substrates, and the gate lines GL and the data lines DL are formed on the lower glass substrate in such a manner to be perpendicular to each other. At each intersection between the gate lines GL and the data lines DL, a thin film transistor (TFT) for selectively applying an image inputted from the data lines DL to a liquid crystal cell Clc is provided. To this end, the TFT has a drain terminal connected to the gate line GL and a source terminal connected to the data line DL. The drain terminal of the TFT is connected to a pixel electrode of the liquid crystal cell Clc.

The system driver 51 converts an analog input image signal into a digital image signal suitable for the liquid crystal panel 56 and detects a synchronizing signal included in the image signal. A low voltage differential signal (LVDS) interface and a TTL interface are mainly used for data and control signal transmissions of the system driver 1. Alternatively, such interface functions, along with the timing controller 2, may be integrated into a single chip. In the LVDS interface, various data may be compressed to a single line and inputted to the timing controller 52.

The timing controller 52 applies red (R), green (G), and blue (B) data signals received from the system driver 51 to the data driver 53. Also, the timing controller 52 generates a dot clock Dclk and a gate start pulse GSP using horizontal/vertical synchronizing signals H and V and a data enable signal DE inputted from the system driver 51, thereby controlling a timing of the data driver 53 and the gate driver 55. The dot clock Dclk is applied to the data driver 53 while the gate start pulse GSP is applied to the gate driver 55.

The gate driver 55 includes a shift register for responding to the gate start pulse GSP inputted from the timing controller 52 to sequentially generate a scanning pulse, and a level shifter for shifting a voltage of the scanning pulse into a voltage level suitable for driving the liquid crystal cell. Video data at the data line DL is applied to a pixel electrode of the liquid crystal cell Clc by the TFT in response to the scanning pulse inputted from the gate driver 55.

The dot clock Dclk, along with the R, G, and B data signals from the timing controller 52, is inputted to the data driver 53. The data driver 53 latches the R, G, and B digital video data in synchronization with the dot clock Dclk and then corrects the latched data in accordance with a gamma voltage Vγ. Thereafter, the data driver 53 converts the data corrected by the gamma voltage Vγ into analog data and supplies them to the data line DL line by line.

The gamma voltage generator 54 generates a gamma voltage Vγ corresponding to data for a gray scale value based on an electro-optical characteristic of a liquid crystal display panel. The gamma voltage Vγ is a voltage divided in correspondence with a gray level by means of the gamma voltage generator 54. Thus, the gamma voltage Vγ generated from the gamma voltage generator 54 has a different voltage magnitude in correspondence with a gray scale value selected in an expressible range.

Figure 7:
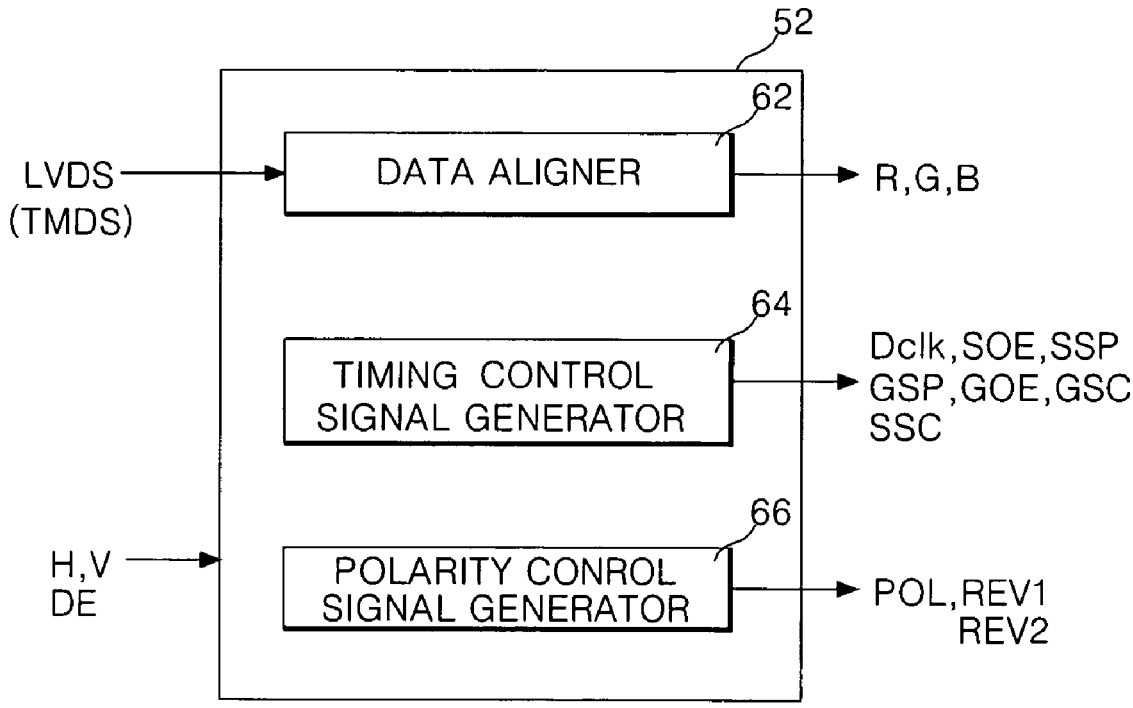
FIG. 7 is a detailed block diagram of the timing controller of FIG. 6.

FIG. 7 is a detailed block diagram of the timing controller 52 of FIG. 6.

Referring to FIG. 7, the timing controller 52 generates desired signals for driving an LCD using the low voltage differential signal LVDS and the vertical and horizontal synchronizing signals H and V from the system driver 51.

The LVDS applies R, G, and B data signals through a data aligner 62 to the data driver 53. The vertical and horizontal synchronizing signals V and H apply timing control signals through a timing control signal generator 64 to the data driver 53 and the gate driver 55 (both shown in FIG. 6).

Control signals required for the data driver 53 in the timing signals include a source sampling clock SSC, a source output enable signal SOE, and a source start pulse SSP, etc. On the other hand, control signals required for the gate driver 55 include a gate shift clock GSC, a gate output enable signal GOE, and a gate start pulse GSP, etc.

The horizontal and vertical synchronizing signals H and V apply a polarity control signal through a polarity control signal generator 66 to the data driver 53 and the gate driver 55. The polarity control signals include POL, REV1 and REV2, etc. In this case, the REV1 is a signal for determining whether or not polarities of odd data are to be inverted by a data transition of the current data and the previous data while the REV2 is a signal for determining whether or not the polarities of even data are to be inverted by a data transition of the current data and the previous data.

Such an LCD applies the data signals and the control signals from the system driver 51 through the timing controller 52 to the data driver 53 and the gate driver 55.

Figure 8A:
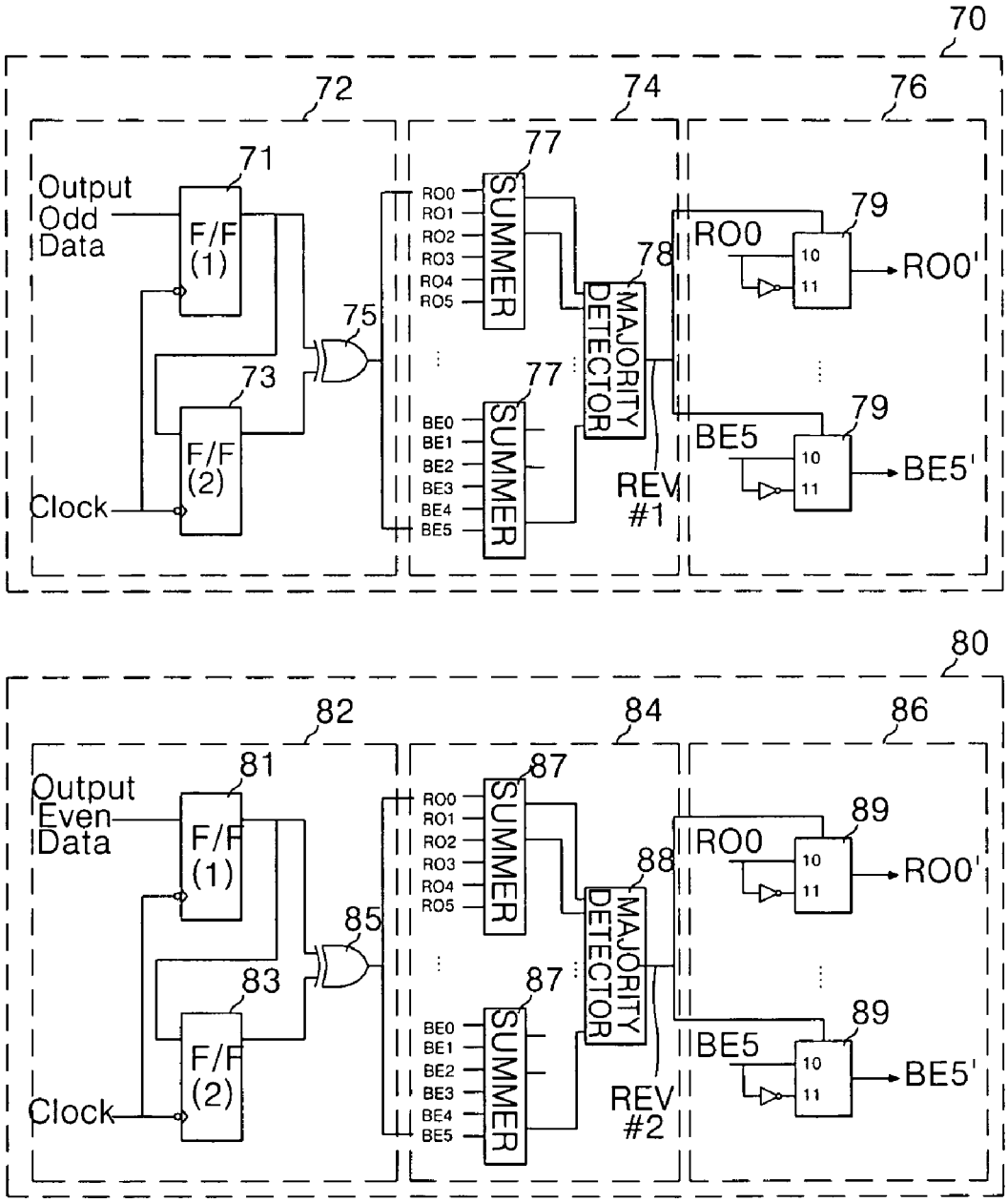
FIG. 8A is a detailed block diagram of a REV transmitter of the timing controller according to a first embodiment of the present invention.

FIG. 8A is a detailed block diagram of a REV transmitter of the timing controller 52 according to a first embodiment of the present invention.

In FIG. 8A, the REV transmitter includes a REV1 driver 70 for checking data transitions of odd data to output a polarity control signal, and a REV2 driver 80 for checking data transitions of even data to output a polarity control signal.

The REV1 driver 70 includes a first data transition part 72 for checking data transitions of odd data, a REV1 signal summer 74 for detecting the number of signals in which a polarity of the data according to the data transitions is changed to determine an output level, and a REV1 signal output 76 for receiving signals from the first data transition part 72 and the REV1 signal summer 74 to generate a signal for inverting output data.

The first data transition part 72 consists of two flip-flops 71 and 73, and an exclusive logical sum gate (XOR) 75. The first data transition part 72 compares the data inputted to the current data flip-flop 71 with the data inputted to the previous data flip-flop 73 and detects whether the data are changed into a high logic '1' or a low logic '0'. If there is a transition in the data, the first data transition part 72 outputs a high logic '1'. Conversely, the first data transition part 72 outputs a low logic '0' if there is no transition. In this case, the data is sequentially compared regardless of whether it is even data EVEN or odd data ODD.

The REV1 signal summer 74 adds all the number of a data transition through the first data transition part 72 by means of an adder 77 with respect to eighteen R, G, and B odd data. At this time, it is checked whether the number of a high logic '1', which is an output when there is a data transition, is more than nine that is a half of the total number of the R, G, and B odd data. If the number of a high logic '1' is more than nine, the REV1 having a high logic '1' is outputted. Conversely, if the number of a high logic '1' is less than nine, the REV1 having a low logic '0' is outputted.

The REV1 signal output 76 outputs a signal for inverting output data when an output REV1 of the REV1 signal summer 74 is '1' by a 2×1 multiplexor 79. In other words, in order to reduce an amount of a data transition when the number of data transition is more than a half (i.e., nine) of the total number of data, the REV1 signal output 76 inverts an output signal for a data transition of the output signal by {eighteen — (data transition amount more than nine)} only. Accordingly, an REV1 signal recognizing unchanged input data in a low logic while recognizing an inverted input data in a high logic is inputted to the data driver 53.

The REV2 driver 80 includes a second data transition part 82 for checking data transitions of even data, an REV2 signal summer 84 for detecting the number of signals in which a polarity of the data according to the data transitions is changed to determine an output level, and an REV2 signal output 86 for receiving signals from the second data transition part 82 and the REV2 signal summer 84 to generate a signal for inverting output data.

The second data transition part 82 consists of two flip-flops 81 and 83, and an exclusive logical sum gate (XOR) 85. The second data transition part 82 compares the data inputted to the current data flip-flop 81 with the data inputted to the previous data flip-flop 83 and detects whether the data are changed into a high logic '1' or a low logic '0'. If there is a transition in the data, the second data transition part 82 outputs a high logic '1', while the second data transition part 82 outputs a low logic '0' if there is no transition. In this case, the data is sequentially compared regardless of the status of the data, i.e., even data EVEN or odd data ODD.

The REV2 signal summer 84 adds all the number of a data transition through the second data transition part 82 by means of an adder 87 with respect to eighteen R, G, and B even data. At this time, it is checked whether the number of a high logic '1', which is an output when there is a data transition, is more than nine that is a half of the total number of the R, G, and B even data. If the number of a high logic '1' is more than nine, the REV2 having a high logic '1' is outputted. Conversely, if the number of a high logic '1' is less than nine, the REV2 having a low logic '0' is outputted.

The REV2 signal output 86 outputs a signal for inverting output data when an output REV2 of the REV2 signal summer 84 is '1' by a 2×1 multiplexor 89. In other words, in order to reduce an amount of a data transition when the number of data transition is more than a half (i.e., nine) of the total number of data, the REV2 signal output 86 inverts an output signal for a data transition of the output signal by {eighteen — (data transition amount more than nine)} only. Accordingly, an REV2 signal recognizes unchanged data as input data in a low logic and is inputted to the data driver 53. Conversely, the REV2 signal recognizes inverted data as input data in a high logic to the data driver 53.

Figure 8B:
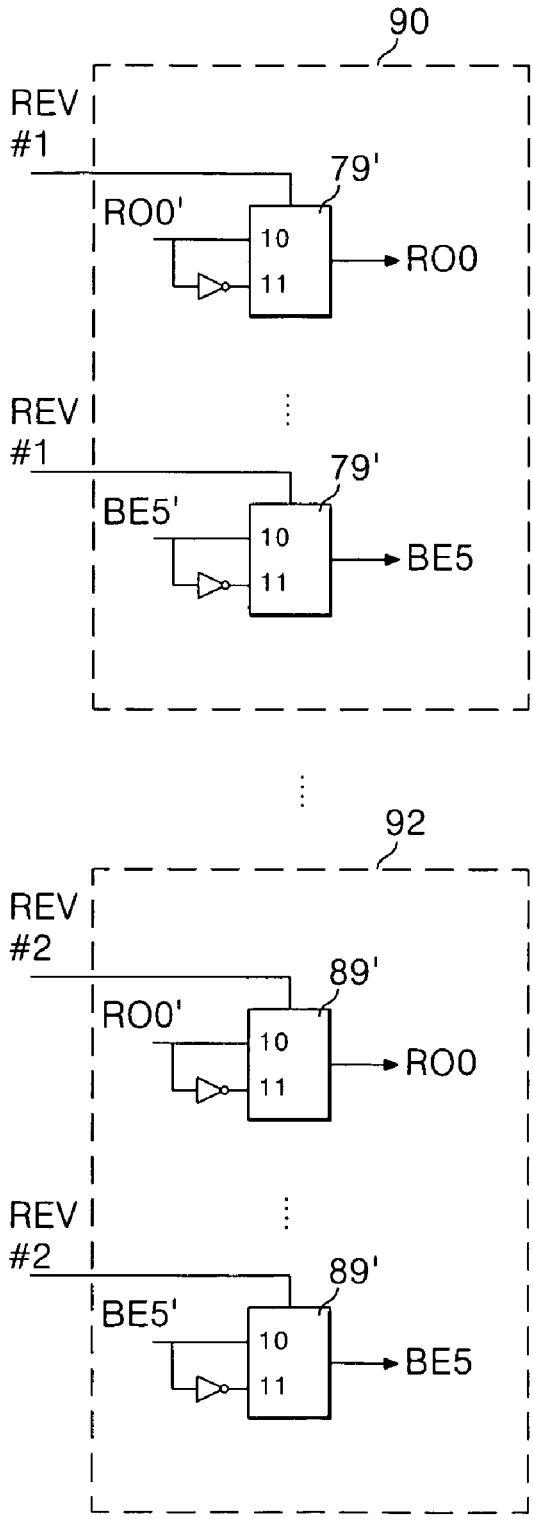
FIG. 8B is a detailed block diagram of a REV receiver of the data driver corresponding to the REV transmitter of FIG. 8A.

FIG. 8B is a schematic block diagram of a REV receiver of the data driver 53 corresponding to the REV transmitter of FIG. 8A.

Referring to FIG. 8B, the REV receivers 90 and 92 include 2×1 multiplexors 79' and 89'. One of input terminals of the multiplexors 79' and 89' is connected such that signals outputted from the multiplexors 79 and 89 of the REV signal output parts 76 and 86 in FIG. 8A are inputted without a transition, while another input terminal thereof is connected such that the signals from the REV signal output parts 76 and 86 are inputted with an inverted state. The REV signals inputted to the multiplexors 79' and 89' are selected as the normal signals or the inverted signals by a high signal ('1') or a low signal ('0') from the majority detectors 78 and 88 of the REV signal summers 74 and 84. The signals are then inputted to a latch circuit configuring the data driver 53, thereby inverting the polarities of the R, G, and B data.

Figure 9:
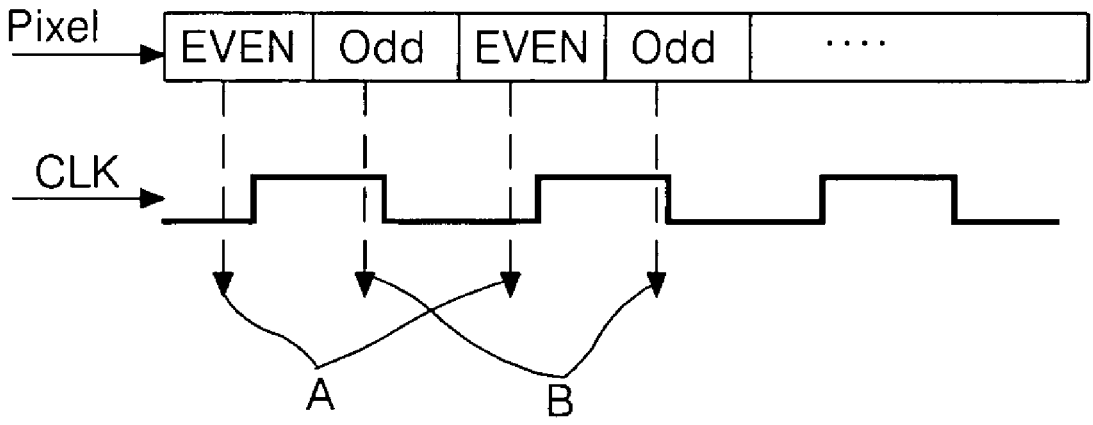
FIG. 9 schematically illustrates a REV driving method according to the present invention.

FIG. 9 schematically illustrates an REV driving method according to the present invention.

Referring to FIG. 9, an REV driving method in the present invention divides data into even data EVEN and odd data ODD and compares with each other. Herein, "A" represents a comparison of $1^{st}$ even clock data with $2^{nd}$ even clock data, and "B" does a comparison of $1^{st}$ odd clock data with $2^{nd}$ odd clock data. Accordingly, the eighteen bits of data are compared with each other by the REV1 and REV2 in FIG. 8A, thereby reducing a probability of checking a data transition. This effect is explained by an "H" display state and an output shape of the EMI pattern shown in FIGS. 10 to 13.

Figure 10:
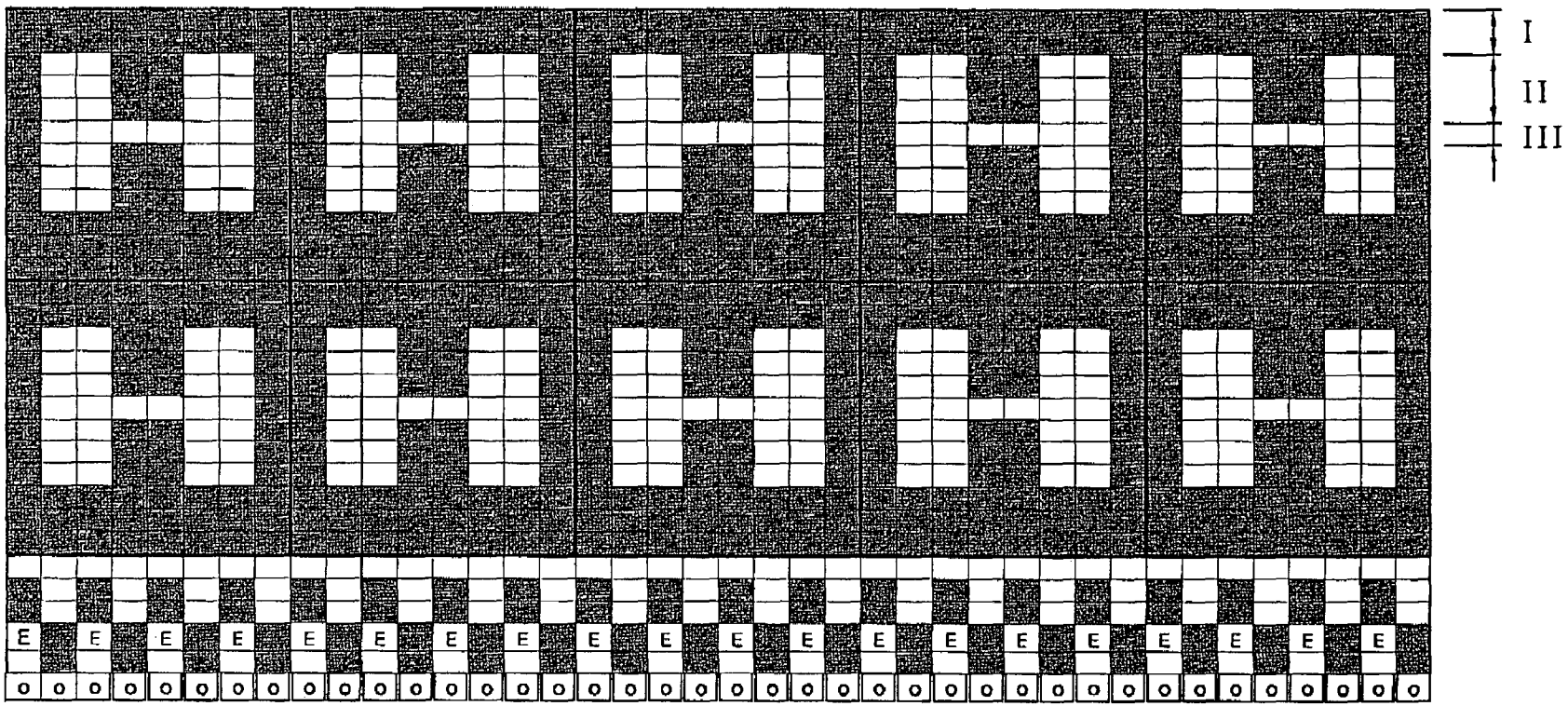
FIG. 10 illustrates an "H" pattern used for an EMI test.

FIG. 10 represents an "H" pattern used for an EMI test.

Referring to FIG. 10, an area provided with an "H" pattern consists of the first two-line shape area (I) at which all the horizontal cells display a gray shape, the second three-line shape area (II) at which a gray pattern and a white pattern appear alternately at a period of two cells, and the third one-line shape area (III) at which a white bar shape is positioned at the center of the "H" pattern. The worst shape among the above shapes is the third shape. The abovementioned effect will be described on the basis of the third shape.

FIGS. 11 to 13 are tables illustrating a data transition at each cell based on the third shape in FIG. 10.

FIG. 11 is a table representing a data output state when the REV signal is turned off, in which a gray pattern is '1' and a white pattern is '0'.

If data are divided into even data and odd data and sequentially inputted to Dn cells, a data output is obtained as shown in FIG. 11. An output waveform having a frequency of about 16 MHz is formed by using the data transition shape.

FIG. 12 illustrates a data output shape by using a 1-port REV signal.

As shown in FIG. 12, the number of data transitions are reduced in comparison to FIG. 11 that the REV signal is turned off. Thus, an output waveform having a frequency of 4 MHz lower than 16 MHz of FIG. 11 is obtained by using the data transition of FIG. 12.

FIG. 13 illustrates a data output shape by using a 2-port REV signal according to the present invention.

In FIG. 13, data are divided into even data and odd data by means of the REV generator as shown in FIG. 8, and transitions of each data are compared with each other. As shown in FIG. 13, the output data indicates no data transition. The output data shape in FIG. 13 is represented as a direct current (DC) output waveform. Accordingly, an EMI characteristic and a current consumption are reduced.

Figure 14A:
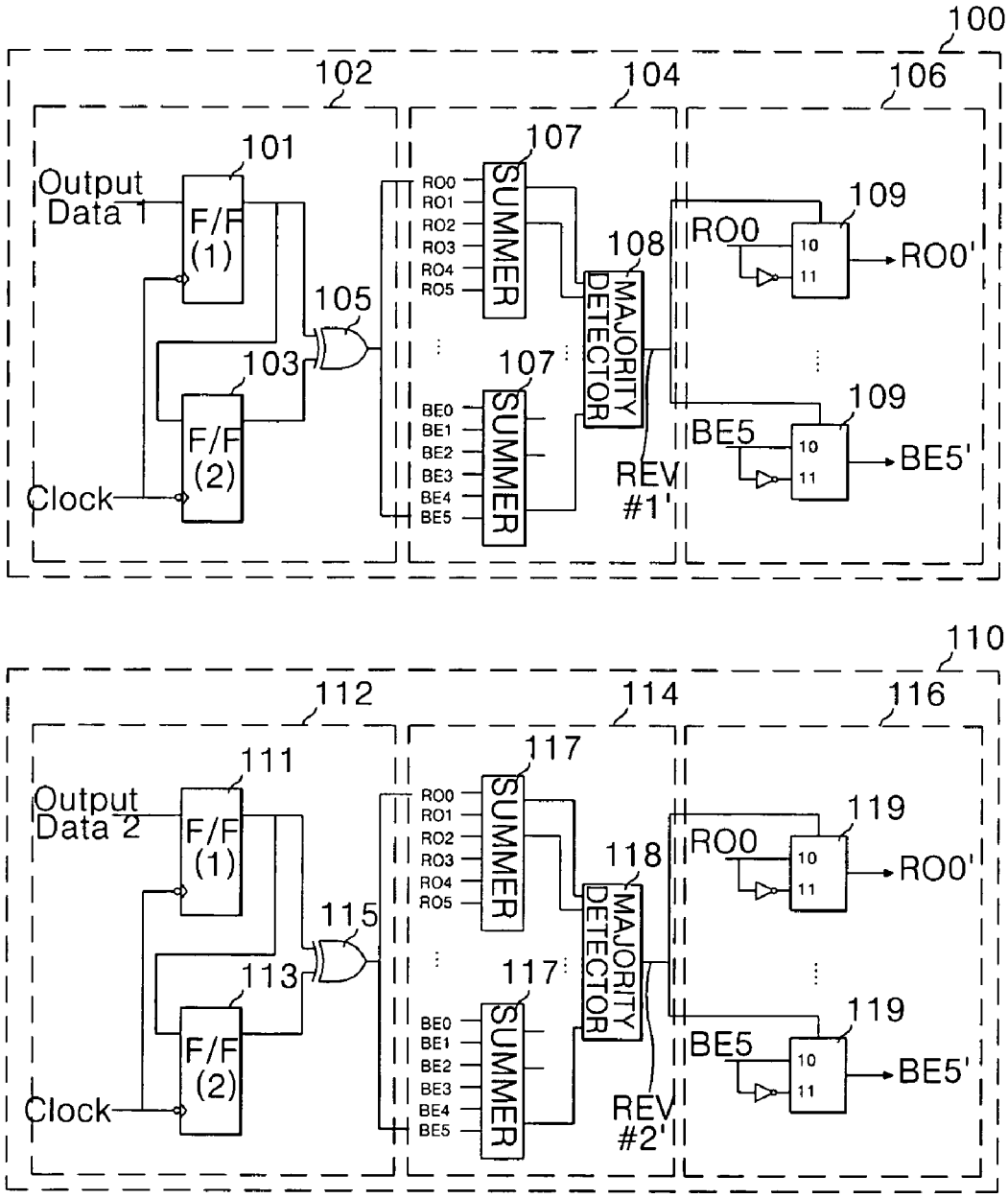
FIG. 14A is a detailed block diagram of a REV transmitter of the timing controller according to a second embodiment of the present invention.

FIG. 14A is a detailed block diagram of a REV transmitter of the timing controller 52 in FIG. 6 according to a second embodiment of the present invention. This represents a data polarity inversion after dividing data inputted to the timing controller into N blocks and inputting the divided data. Herein, the entire data bits have been divided into two blocks.

Referring to FIG. 14A, the REV transmitter includes an REV1 driver 100 for checking a data transition of the first output data divided into two bits to output a polarity control signal, and an REV2 driver 110 for checking a data transition of the second output data to output a polarity control signal.

More specifically, the REV1 driver 100 includes a first data transition part 102 for checking a data transition of the first output data, an REV1 signal summer 104 for detecting the number of signals in which a polarity of the data according to the data transition is changed and determining an output level, and an REV1 signal output 106 for receiving signals from the first data transition part 102 and the REV1 signal summer 104 to generate a signal for inverting the output data.

The first data transition part 102 includes two flip-flops 101 and 103, and an exclusive logical sum gate (XOR) 105. The first data transition part 102 compares the data inputted to the current data flip-flop 101 with the data inputted to the previous data flip-flop 103 to check a data change into a high logic '1' or a low logic '0'. If there is a data transition, the first data transition part 102 outputs a high logic '1'. On the contrary, if there is no data transition, the first data transition part 102 outputs a low logic '0'. In this case, the data are sequentially compared regardless of status of the data, i.e., the first data or the second data.

The REVI signal summer 104 adds all the numbers of a data transition through the first data transition part 102 by means of an adder 107 with respect to eighteen first output data of R, G, and B data. At this time, it is checked whether or not the number of a high logic '1', which is an output when the number of data transition is more than nine that is a half of the total number of the R, G, and B data. If the number of a high logic '1' is more than nine, the REV1 signal having a high logic '1' is outputted. Otherwise, if the number of a high logic '1' is less than nine, the REV1 signal having a low logic '0' is outputted.

The REV1 signal output 106 applies a signal for inverting output data to the data driver 53 when an output REV1 of the REV1 signal summer 104 is '1' by using a 2×1 multiplexor 109. In other words, in order to reduce a data transition amount when the number of a data transition is more than a half (i.e., nine) of the total number of data, the REV1 signal output 106 inverts an output signal for a transition of the output signal by {eighteen—(data transition amount more than nine)} only. Accordingly, an REV1 signal recognizing unchanged data as input data in a low logic is inputted to the data driver 53. Conversely, the REV1 signal recognizing inverted data as input data in a high logic is inputted to the data driver 53.

Next, the REV2 driver 110 includes a second data transition part 112 for checking a data transition of the second output data, an REV2 signal summer 114 for detecting the number of signals in which a polarity of the data according to the data transition is changed, thereby determining an output level, and an REV2 signal output 116 for receiving signals from the second data transition part 112 and the REV2 signal summer 114 to generate a signal for inverting output data.

The second data transition part 112 includes two flip-flops 111 and 113, and an exclusive logical sum gate (XOR) 115. The second data transition part 112 compares the data inputted to the current data flip-flop 111 with the data inputted to the previous data flip-flop 113 to check a data change into a high logic '1' or a low logic '0'. If there is a data transition, the second data transition part 112 outputs a high logic '1'. Conversely, if there is no data transition, the second data transition part 112 outputs a low logic '0'. In this case, the data is sequentially compared regardless of the status of the data, i.e., the first data and the second data.

The REV2 signal summer 114 adds all the numbers of a data transition through the second data transition part 112 by means of an adder 117 with respect to each eighteen second output data R, G, and B data. At this time, it is checked whether the number of a high logic '1', which is an output when the number of the data is more than nine (that is, a half of the total number of the second R, G and B data). If the number of a high logic '1' is more than nine, the REV2 having a high logic '1' is outputted. Conversely, if the number of a high logic '1' is less than nine, the REV2 having a low logic '0' is outputted.

The REV2 signal output 116 outputs a signal for inverting output data when an output REV2 of the REV2 signal summer 74 is '1' by using a 2×1 multiplexor 109. In other words, in order to reduce a data transition amount when the number of a data transition is more than a half (i.e., nine) of the total number of data, the REV2 signal output 106 inverts an output signal for a transition of the output signal by {eighteen—(data transition amount more than nine)} only. Accordingly, an REV2 signal recognizing unchanged data as input data in a low logic. Conversely, the REV2 signal recognizing inverted data as input data in a high logic is inputted to the data driver 53.

Figure 14B:
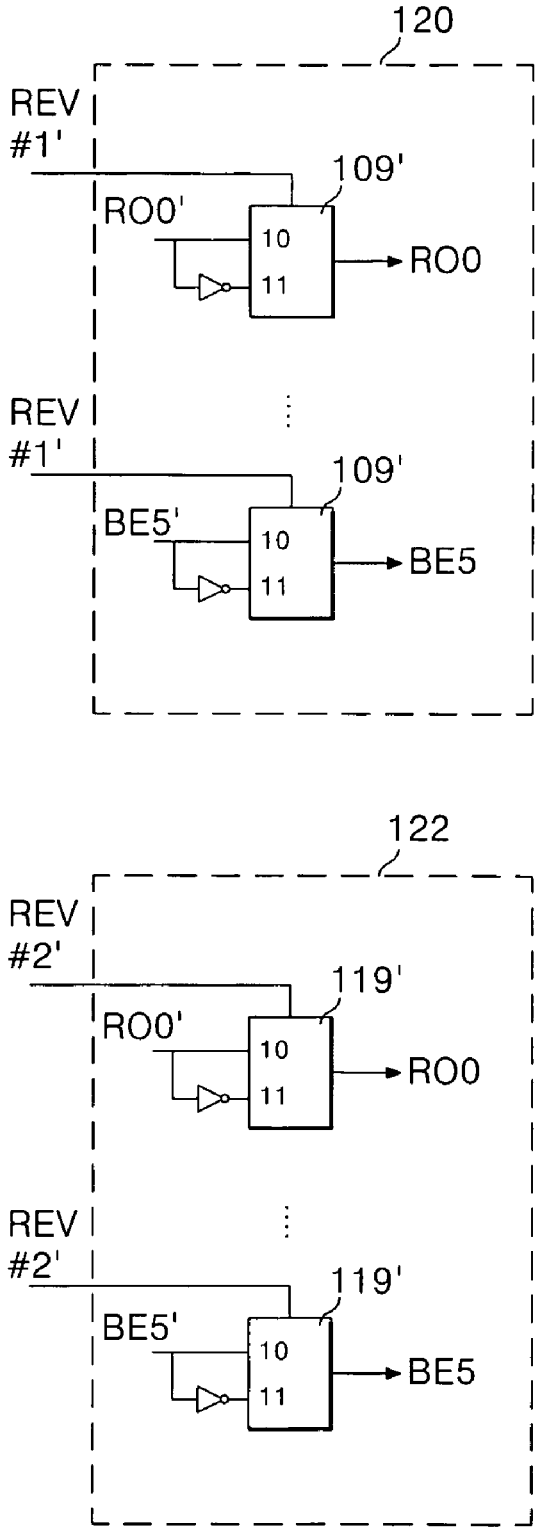
FIG. 14B is a detailed block diagram of a REV receiver of the data driver corresponding to the REV transmitter of FIG. 14A.

FIG. 14B is a schematic block diagram of an REV receiver of the data driver 53 in the REV transmitter shown in FIG. 14A.

Referring to FIG. 14B, the REV receivers 120 and 122 include 2×1 multiplexors 109' and 119'. One of input terminals of the multiplexors 109' and 119' is connected such that signals outputted through the multiplexors 109 and 119 of the REV signal outputs 106 and 116 in FIG. 14A are inputted without a transition. Another input terminal thereof is connected such that the signals from the REV signal outputs 106 and 116 in FIG. 14A are inputted with an inverted state. The REV signals inputted to the multiplexors 109' and 119' are selected as the unchanged signals or the inverted signals by a high signal ('1') or a low signal ('0') from the majority detectors 108 and 118 of the REV signal summers 104 and 114 and then inputted to a latch circuit configuring the data driver 53, thereby inverting the polarities of the R, G, and B data.

As described above, a 2-port REV signal for checking a data transition of the even and odd data and inverting the data is used in the present invention. Thus, a current consumption and an EMI are reduced in a high-resolution mode. Alternatively, data may be inverted after the data are divided into N blocks to check each data transition of the N block data. The data are mainly divided into two blocks.

It will be apparent to those skilled in the art that various modifications and variations can be made in the liquid crystal display with a 2-port data polarity inverter and the method of driving the same of the present invention without departing from the spirit or scope of the inventions. Thus, it is intended that the present invention covers the modifications and variations of this invention provided they come within the scope of the appended claims and their equivalents.

What is claimed is:

1. A liquid crystal display, comprising:

a liquid crystal polarity inversion driver determining whether a polarity of a liquid crystal is inverted and inverting the polarity of the liquid crystal in accordance with the determined result;

a first data inversion driver determining whether a number of transition of odd data having a plurality of bits is more than half of the plurality of bits of the odd data, and inverting the odd data in accordance with the determined result; and a second data inversion driver determining whether a number of transition of even data having a plurality of bits is more than half of the plurality of bits of the even data, and inverting the even data in accordance with the determined result, wherein the first data inversion driver includes a first data transition part determining whether a first data transition has occurred in the odd data and outputting a first signal, a first data inversion signal summer counting the number of the first signal and outputting a first REV signal having a high level or a low level according to the counted number of the first signal, and a first data inversion signal output part receiving the first REV signal from the first data inversion signal summer and outputting either the odd data or an inverted odd data according to the first REV signal, and wherein the second data inversion driver includes a second data transition part determining whether a second data transition has occurred in the even data and outputting a second signal, a second data inversion signal summer counting the number of the second signal and outputting a second REV signal having a high level or a low level according to the counted number of the second signal, and a second data inversion signal output part receiving the second REV signal from the second data inversion signal summer and outputting the even data or an inverted even data according to the second REV signal.

2. The liquid crystal display according to claim 1, wherein the first data transition part includes first and second flip-flops and an exclusive logical sum gate comparing current odd data with previous odd data to determine whether the first data transition has occurred in accordance with the compared result.

3. The liquid crystal display according to claim 1, wherein the second data transition part includes first and second flip-flops and an exclusive logical sum gate comparing current even data with previous even data to determine whether the second data transition has occurred in accordance with the compared result.

4. The liquid crystal display according to claim 1, wherein the first data inversion signal summer includes:

an adder counting the number of the first data transition from the first data transition part; and a majority detector determining whether the counted number of the first data transition is higher than a first reference value.

5. The liquid crystal display according to claim 1, wherein the second data polarity inversion signal summer includes:

an adder counting the number the second data transition from the second data transition part; and a majority detector determining whether the counted number of the second data transition is higher than a second reference value.

6. The liquid crystal display according to claim 1, wherein the first data inversion signal output part includes a multiplexer receiving a first inversion signal from the first data inversion signal summer to invert the output odd data.

7. The liquid crystal display according to claim 1, wherein the second data polarity inversion signal output part includes a multiplexer receiving a second inversion signal from the second data inversion signal summer to invert the output even data.

8. A method of driving a liquid crystal display having first and second data inversion drivers, the method comprising:

dividing input data into odd data and even data;

comparing current odd data with previous odd data and current even data with previous even data to determine a first data transition and a second data transition, respectively;

determining a number of first and second data transitions in the odd and even data, respectively; and inverting the odd and even data in accordance with the determined results, respectively, wherein inverting the odd and even data includes inverting the odd data and outputting the inverted odd data if the number of the first data transition is more than half of a total number of the odd data bit, and outputting the odd data without an inversion if the number of the first data transition is less than or equal to the half of the total number of the odd data bit, and inverting the even data and outputting the inverted even data if the number of the second data transition is more than half of a total number of the even data bit, and outputting the even data without an inversion if the number of the second data transition is less than or equal to the half of the total number of the even data bit.

9. The method according to claim 8, wherein the total number of the odd data bit is 18.

10. A 2-port data polarity inverter for driving a liquid crystal display, comprising:

an odd data inversion driver to generate a first inversion signal to invert odd data when a number of a first data transition is more than half of a total number of the odd data; and an even data inversion driver to generate a second inversion signal to invert even data when a number of a second data transition is more than half of a total number of the even data, wherein the odd data inversion driver includes a first data transition part to determine whether the first data transition has occurred in the odd data and outputting a first signal, a first data inversion signal summer counting the number of the first signal and outputting a first REV signal having a high level or a low level according to the counted number of the first signal, and a first data inversion signal output part receiving the first REV signal from the first data inversion signal summer and outputting the odd data or an inverted odd data according to the first REV signal, and wherein the second data inversion driver includes a second data transition part to determine whether the second data transition has occurred in the even data and outputting a second signal, a second data inversion signal summer counting the number of the second signal and outputting a second REV signal having a high level or a low level according to the counted number of the second signal, and a second data inversion signal output part receiving the second REV signal from the second data inversion signal summer and outputting the even data or an inverted even data according to the second REV signal.

11. The 2-port data polarity inverter according to claim 10, wherein the first data transition part includes first and second flip-flops and a first exclusive logical sum gate to compare current odd data with previous odd data to determine whether the first data transition has occurred in accordance with the compared result, and wherein the second data transition part includes third and fourth flip-flops and a second exclusive logical sum gate to compare current even data with previous even data to determine whether the second data transition has occurred in accordance with the compared result.

12. The 2-port data polarity inverter according to claim 10, wherein the first data inversion signal summer includes a first adder counting the number of the first data transition from the first data transition part, and a first majority detector to determine whether the counted number of the first data transition is higher than a first reference value; and wherein the second data inversion signal summer includes a second adder counting the number of the second data transition from the second data transition part; and a second majority detector to determine whether the counted number of the second data transition is higher than a second reference value.

13. The 2-port data polarity inverter according to claim 10, wherein the first data inversion signal output part includes a first multiplexer receiving the first REV signal from the first data inversion signal summer to invert the odd data, and wherein the second data inversion signal output part includes a second multiplexer receiving the second REV signal from the second data inversion signal summer to invert the even data.

* * * * *